United States Patent [19]

Karasawa

[11] 4,056,896

[45] Nov. 8, 1977

[54] TOY BIRD

[75] Inventor: Hideyasu Karasawa, Tokyo, Japan

[73] Assignee: Tomy Kogyo Co., Inc., Tokyo, Japan

[21] Appl. No.: 718,095

[22] Filed: Aug. 26, 1976

[30] Foreign Application Priority Data

Aug. 29, 1975 Japan ..... 50-120269[U]

[51] Int. Cl.[2] ..... A63H 11/04

[52] U.S. Cl. ..... 46/132; 46/179

[58] Field of Search ..... 46/132, 117, 118, 124, 46/174, 178, 179

[56] References Cited

U.S. PATENT DOCUMENTS

| | | | |
|---|---|---|---|
| 547,553 | 10/1895 | Keller | 46/124 |
| 2,064,119 | 12/1936 | Irenius | 46/132 |
| 2,121,175 | 6/1938 | Savage | 46/118 |
| 2,953,869 | 9/1960 | Collischan | 46/179 |
| 3,983,661 | 10/1976 | Zitzmann | 46/132 |

*Primary Examiner*—Louis G. Mancene
*Assistant Examiner*—Mickey Yu
*Attorney, Agent, or Firm*—Staas & Halsey

[57] ABSTRACT

A toy bird having a housing, within the housing are two sheaves mounted to a common shaft for rotation together, one of the sheaves having a larger inside diameter that the other, a first wing and a second wing disposed outside the housing, each wing being provided with a tang that passes through an opening provided in the housing and which is mounted for rotation within the housing independently of the other tang, two resilient cords, each cord passing through a separate opening provided in the housing and attached to one of the sheaves, the cord passing through the opening on the upper section of the housing being attached to the sheave having the smaller inside diameter so that when each cord is pulled with approximately equal force the housing moves towards the end of the cord attached to the sheave having the smaller inside diameter, a shaft positioned off-center to the shaft attached to the two sheaves and passing through openings provided in the tang members causing its tang members to move when the sheaves are rotated, a cylinder and a piston mounted for reciprocal movement within the cylinder, the piston being operatively connected to the shaft that passes through the two openings, a sound producing mechanism is pneumatic connection with the bottom of the cylinder so that when the bird housing is caused to be moved upwardly and downwardly by force being applied or removed from one or both of the two cords, the wings "flutter" upwardly and downwardly and a sound is emitted each time the piston reciprocates in the cylinder.

6 Claims, 5 Drawing Figures

FIG. 3
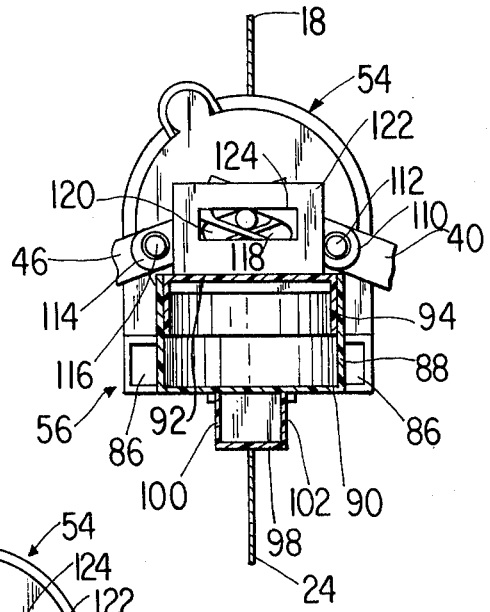
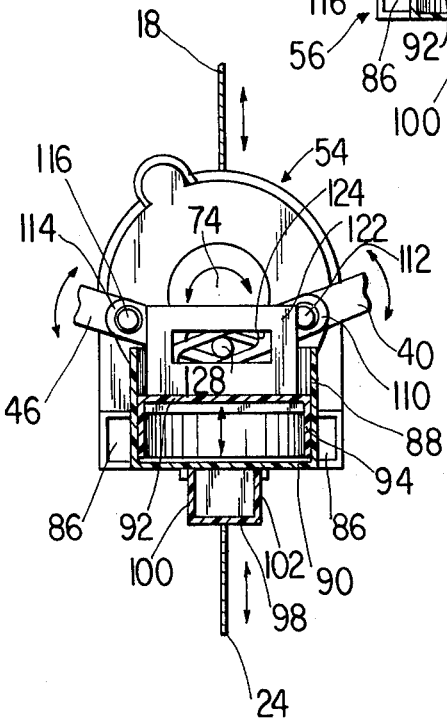
FIG. 4
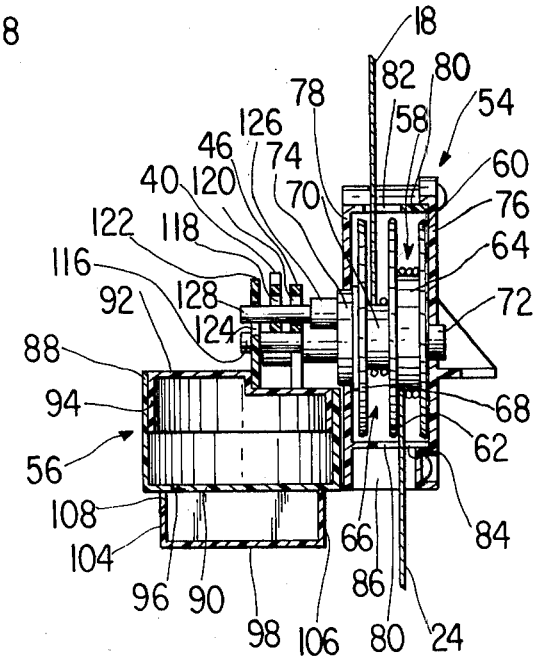
FIG. 5

TOY BIRD

BACKGROUND AND SUMMARY OF THE INVENTION

The present invention relates generally to a toy bird and more particularly to a toy bird which makes a whistling sound when operated.

The toy bird of the present invention is provided with a housing within which are located two sheaves mounted on a common shaft for rotation together, one of the sheaves having a larger inside diameter than the other. A wing is disposed on either side of the housing. Each wing is provided with a tang which extends into the housing. Each tang is mounted for rotation in the housing independently of the other tang. Two cords are provided, each passing through an opening in the housing. One of the cords is attached to the sheave having the larger inside diameter so that when the cords are pulled with equal force, the greater moment arm created by the sheave having the larger diameter causes the housing to move towards the end of the cord attached to the sheave having the smaller inside diameter.

A cylinder and piston mounted for reciprocal movement therein are disposed in the housing and a whistle is in pneumatic connection with the lower end of the cylinder. A whistling sound is emitted when the piston moves in the cylinder. A plate member is mounted to the top of the piston. Passing through an opening provided in this plate member and through openings provided in each of the tangs is a shaft. This shaft is mounted off-center to the shaft that mounts the two sheaves for rotation together. When the two sheaves are rotated by the cords, the tangs, and hence their respective wings, move upwardly and downwardly and a whistling sound is emitted each time the piston moves inwardly in the cylinder.

BRIEF DESCRIPTION OF THE DRAWINGS

FIG. 3 is a cross-sectional view taken along line 3—3 of FIG. 2 illustrating in particular the two tangs and the piston in their end positions;

FIG. 4 is a cross-sectional view taken along line 3—3 of FIG. 2 illustrating in particular the two tangs and the piston in their other end positions; and FIG. 5 is a cross-sectional view taken along line 5—5 of FIG. 2.

DESCRIPTION OF THE PREFERRED EMBODIMENT

Figure 1:
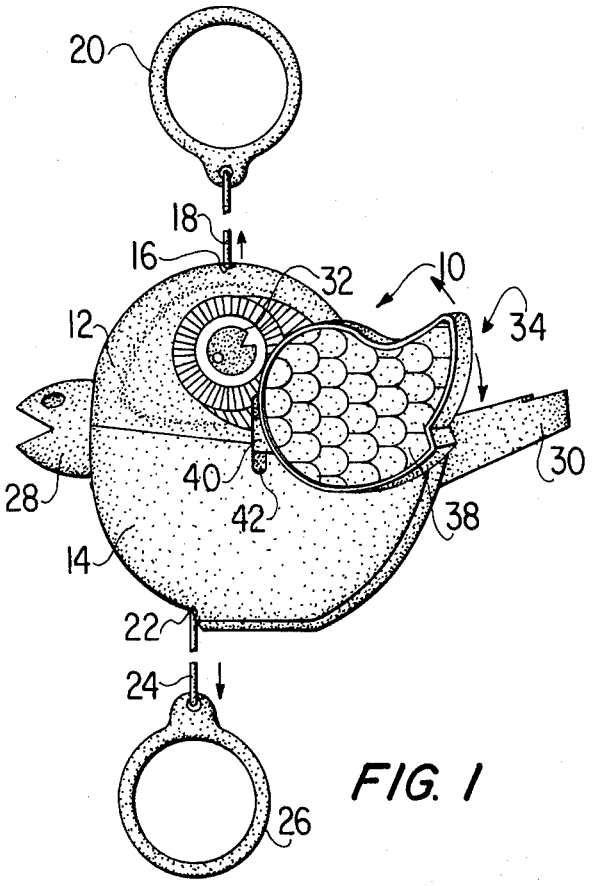
FIG. 1 is a side elevational view of the toy bird illustrating the sections of the housing, the cords, and one of the wings.

The toy bird of the present invention has a housing which is designated generally by the reference numeral 10. Housing 10 includes, as illustrated in FIG. 1, an upper section 12 and a lower section 14. It will be readily apparent that the housing may be formed of side-by-side sections, or other equivalent structure. Passing through opening 16 provided in upper section 12 is a cord 18 which may be provided with a ring 20, if desired. Passing through an opening 22 provided in lower section 14 is a cord 24 which may be provided with a ring 26, if desired.

As further illustrated in FIG. 1, the toy bird of the present invention may be provided with a beak 28 which is mounted on the front of housing 10 and with a tail 30 which is mounted on the back of housing 10. Moreover, the upper section 12 may be provided with decorative markings 32, if desired.

Figure 2:
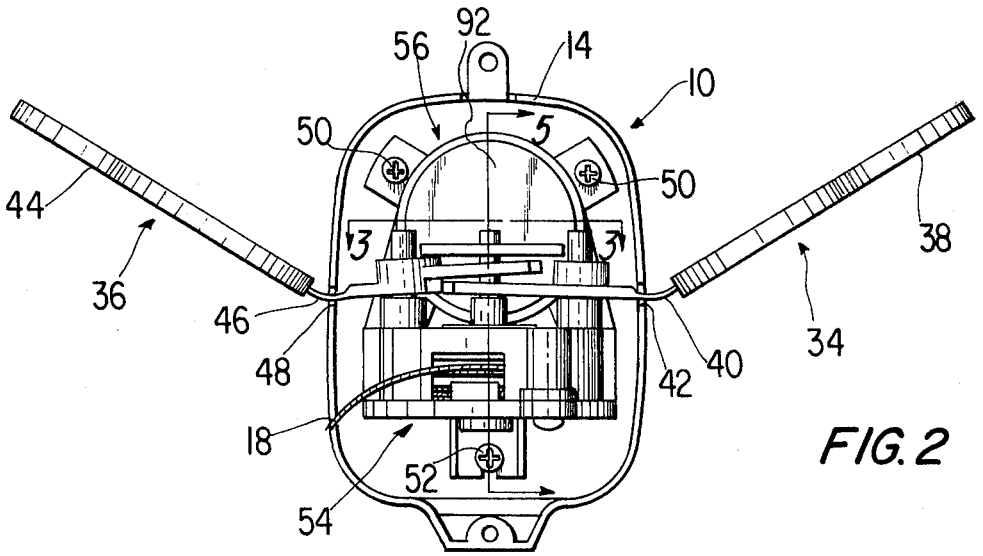
FIG. 2 is a top plan view of the toy bird with a section of the housing removed illustrating the operating mechanisms within the housing.

As will be apparent from FIGS. 1 and 2, a wing which is designated generally by the reference numeral 34 is provided on the right side of the housing 10 and a wing which is designated generally by the reference numeral 36 is provided on the left side of the housing 10. Wing 34 includes a member 38 which has a tang 40 that extends through an opening 42 provided in housing 10. Wing 36 in similar manner includes a member 44 which has a tang 46 that extends through an opening 48 provided in housing 10. The openings 42 and 48 are of a size and shape to permit tangs 40 and 46, respectively, to move upwardly and downwardly without interference. As illustrated in FIG. 2, the mechanisms disposed in housing 10 are secured to lower section 14 by screws 50 and 52.

Turning now to FIGS. 3, 4, and 5, it will be seen that the operating mechanisms disposed in housing 10 include a sheave housing which is designated generally by the reference numeral 54 and a whistle assembly which is designated generally by the reference numeral 56.

A sheave 58 disposed in sheave housing 54 consists of a wall 60 and a wall 62 that are substantially parallel to each other and a cylindrical post or tube 64 interposed between walls 60 and 62 and perpendicular thereto, as illustrated in FIG. 5. Moreover, a sheave 66 also disposed in sheave housing 50 consists of a wall 68 and the wall 62 that are substantially parallel to each other and a cylindrical post or tube 70 interposed between walls 68 and 62 and perpendicular thereto. Cylindrical tube 64 is of a greater diameter than cylindrical tube 70. Since sheave 58 and sheave 66 have wall 62 in common, they move together and are mounted to shafts 72 and 74 which are mounted for rotation in openings provided in mounting abutments 76 and 78, respectively, of sheave housing 54. Sheave housing 54 is provided with a cylindrical side wall 80 that is perpendicular to mounting abutments 76, 78. In the upper area of side wall 80 disposed above sheave 66 there is provided an opening 82 through which cord 18 passes. Cord 18 is attached to cylindrical tube 70. In the lower area of side wall 80 disposed below sheave 58 there is provided an opening 84 through which cord 24 passes. Cord 24 is attached to cylindrical tube 64.

As will be apparent from FIGS. 3, 4, and 5, a channel 86 is provided on either side of and disposed below sheave housing 54. Channels 86 provide the mountings to which whistle assembly 56 is attached. When so attached, whistle assembly 56 is substantially perpendicular to mounting abutment 78, as illustrated in FIG. 5.

It will also be apparent from FIGS. 3, 4 and 5, that whistle assembly 56 includes a cylinder 88 having an end wall 90 at the lower edge thereof. A piston 92 having a side wall 94 is disposed in cylinder 88. The outside diameter of side wall 94 is substantially equal to the inside diameter of cylinder 88 which allows piston 92 to reciprocate within cylinder 88 while maintaining a pneumatic seal between side wall 94 and cylinder 88. An input opening 96 is provided in end wall 90 so as to provide a pneumatic connection between the interior of cylinder 88 and a rectangular whistle housing (of well known construction in the art) having side walls 98, 100 and 102 and end walls 104 and 106. An output opening 108 is provided in end wall 104 which is disposed below the input opening 96.

It will be further noted from FIGS. 3, 4 and 5, that tang 40 is provided with a collar 110 that mounts tang 40 for rotation on a shaft 112 that is mounted to abutment 78 and extends outwardly therefrom and perpendicular thereto. Similarly, tang 46 is provided with a collar 114 that mounts tang 46 for rotation on a shaft 116 that is mounted to abutment 78 and extends outwardly therefrom and perpendicular thereto. Along tang 40 between the end thereof and collar 110 there is provided a channel opening 118. Similarly, along tang 46 between the end thereof and collar 114 there is provided a channel opening 120. Moreover, attached to piston 92 and extending upwardly and generally perpendicular thereto is a plate member 122 that has a channel opening 124 provided therein. Mounted to shaft 74 on an abutment 126 that is offset from the center line of shaft 74 is a shaft 128 that is generally perpendicular to shaft 74. Shaft 128, in turn, extends through channel openings 118, 120 and 124.

The operation of the toy bird of the present invention will now be described. The child holds rings 20 and 26 with ring 20 being held above ring 26. When an approximately equal force is applied to each cord 18 and 24 away from housing 10 by the child, the housing 10 will move upwardly towards ring 20 because of the greater moment arm developed by sheave 58 since cylindrical tube 64 is of a larger diameter than cylindrical tube 70. This greater moment arm causes cord 18 to be wound on sheave 16 simultaneously with the unwinding of cord 24 from sheave 58. It will be noted that the distance between rings 20 and 26 remains the same. The rotation of the two sheaves 58 and 66 together causes shaft 74 and shaft 72 mounted thereon to rotate. Since shaft 128 is offset from the center line of shaft 74, shaft 128 moves upwardly and downwardly with respect to the center line of shaft 74. Since shaft 128 passes through channel openings 118, 120 and 124, the tangs 40 and 46 and piston 92 are moved upwardly and downwardly therewith. The movement of tangs 40 and 46 upwardly and downwardly causes a similar movement of members 38 and 44, respectively, which causes the two wings 34, 36 appear to "flap" upwardly and downwardly. Simultaneously, the movement of piston 92 downwardly within cylinder 88 causes a whistling sound to be emitted due to the pneumatic connection through input opening 96 between the interior of cylinder 88 and the interior of the rectangular whistle housing disposed therebetween and due to the pneumatic connection through output opening 108 between the rectangular whistle housing and the ambient air. Thus, when cords 18 and 24 are pulled when cord 18 is disposed above cord 24, the housing 10 of the present invention moves upwardly towards ring 20 while the wings 34, 36 "flutter" upwardly and downwardly with a whistling sound being emitted each time piston 92 moves downwardly within cylinder 88.

When the force being applied to cord 24 is removed, the mass of the bird of the present invention under the influence of gravity causes the bird to slowly move downwardly and away from ring 20 while wings 34, 36 "flutter" upwardly and downwardly with a whistling sound being emitted each time piston 92 moves downwardly within cylinder 88. The toy bird of the present invention will continue to move downwardly and away from ring 20 under its own weight until cord 18 has been completely unwound from sheave 66 while cord 24 has been completely wound onto sheave 58. The child may stop playing with the toy bird of the present invention at any stage in the operation of the toy.

I claim:

1. A toy bird, comprising:

a housing, sheave means mounted for rotation within said housing and being provided with two separate posts of different dimension, a cord having two pieces, one of said pieces wound around one of said posts while the other of said pieces is wound around the other of said posts, said cord extending outwardly of said housing such that as said cord is pulled said sheave means rotates, wing means operably mounted for movement with respect to said housing and provided with slots, means operatively connecting said wing means and said sheave means, including a shaft offset from the axis of rotation of said sheave means and extending through said slots of said wing means such that as said sheave means rotates said wing means moves, noise producing means within said housing, and means operatively connecting said noise producing means and said sheave means such that as said sheave means rotates, said noise producing means operates.

2. A toy bird as in claim 1, wherein said noise producing means is activated by the passage of air therethrough, and wherein said means operatively connecting said noise producing means and said sheave means comprises a shaft offset from the axis of rotation of said sheave means, a cylinder operatively connected to and in fluid connection with said noise producing means, and a piston mounted for reciprocating movement within said cylinder and connected to said shaft.

3. A toy bird as in claim 1, wherein said noise producing means comprises a cylinder disposed within said housing, said cylinder being hollow and having a closed first end and an open second end, a piston mounted for reciprocation within said cylinder and including a top wall and a cylindrical side wall depending therefrom, the outside diameter of said cylindrical side wall being substantially equal to the inside diameter of said cylinder maintaining a pneumatic seal therebetween, an element for producing an audible sound when air is forced therethrough being in pneumatic connection with the interior of said first cylinder at the closed end thereof, and means operatively connecting said piston at said top wall thereof to said means operatively connecting said sheave means and said wing means such that when said sheave means rotates said piston reciprocates within said cylinder causing said element to produce a sound.

4. In a toy having an element which produces a sound when air is moved therethrough and at least one member mounted for movement, the improvement comprising a sheave mounted for rotation about an axis and provided with first and second posts of different size and a first shaft extending outwardly therefrom at a position offset from said axis thereof, first and second cords attached to said first and second posts, respectively, a chamber within which said element is located, a plunger mounted for reciprocating movement within said chamber, said plunger being provided with a first elongated opening through which said first shaft of said sheave extends permitting the rotation of said sheave to move said plunger back and forth within said chamber forcing air through said element, a second stationary shaft, said member being provided with an opening therein through which said second shaft extends permitting said member to rotate about said second shaft, said member also being provided with a second elongated opening through which said first shaft of said sheave extends permitting the rotation of said sheave to rotate said one member about said second shaft.

5. A toy as in claim 4, further comprising a second member mounted for movement, a third stationary shaft, said second member being provided with an opening therein through which said third shaft extends permitting said second member to rotate about said third shaft, said second member also being provided with a third elongated opening through which said first shaft of said sheave extends permitting the rotation of said sheave to rotate said second member about said third shaft.

6. A toy as in claim 4, further comprising a housing within which said sheave is mounted for rotation, said housing being provided with an opening which is of a dimension at least twice the distance said first shaft is offset from the axis of rotation of said sheave such that said first shaft of said sheave extends through said opening and is free to rotate within said opening, said second and third shafts about which said members rotate extending outwardly from said housing, said housing also being provided with openings through which said first and second cords extend.

* * * * *